US007548213B2

(12) United States Patent
Koyama et al.

(10) Patent No.: US 7,548,213 B2
(45) Date of Patent: Jun. 16, 2009

(54) GAME CHIP

(75) Inventors: Toshimi Koyama, Tokyo (JP); Nobuyuki Nonaka, Tokyo (JP); Jituo Migita, Kochi (JP)

(73) Assignees: Aruze Corp., Tokyo (JP); Seta Corp., Tokyo (JP); Minerva Corp., Kochi (JP)

( * ) Notice: Subject to any disclaimer, the term of this patent is extended or adjusted under 35 U.S.C. 154(b) by 492 days.

(21) Appl. No.: 11/300,598

(22) Filed: Dec. 15, 2005

(65) Prior Publication Data

US 2006/0223639 A1 Oct. 5, 2006

(30) Foreign Application Priority Data

Dec. 20, 2004 (JP) ..... 2004-367239

(51) Int. Cl.
*H01Q 7/08* (2006.01)

(52) U.S. Cl. ..... 343/788

(58) Field of Classification Search ..... 343/788, 343/700 MS; 273/309, 288, 290
See application file for complete search history.

(56) References Cited

U.S. PATENT DOCUMENTS 5,651,548 A 7/1997 French et al.
5,676,376 A * 10/1997 Valley ..... 273/288
5,751,256 A 5/1998 McDonough et al.
2003/0117336 A1 6/2003 Droz

FOREIGN PATENT DOCUMENTS

| | | | |
|---|---|---|---|
| CN | 1113332 | | 12/1995 |
| CN | 1425169 | | 6/2003 |
| EP | 1 455 302 | | 9/2004 |
| JP | 2003-085504 | | 3/2003 |
| JP | 2003117066 A | * | 4/2003 |
| JP | 2003-196634 | | 7/2003 |
| JP | 2004-021648 | | 1/2004 |
| JP | 2004-102953 | | 4/2004 |

* cited by examiner

*Primary Examiner*—Trinh V Dinh
*Assistant Examiner*—Dieu Hien T Duong
(74) *Attorney, Agent, or Firm*—Leydig, Voit & Mayer, Ltd.

(57) ABSTRACT

The present invention relates to the technology of recognizing and reading each game chip although game chips are stacked. The present invention is a game chip storing data readable by a reader/writer having an antenna which emits an electromagnetic wave and available in a stack of game chips, and includes: an IC device for communicating data at a request from the reader/writer; an antenna electrode connected to the IC device, and configured such that the antenna electrode can enter a resonant state with an antenna of the reader/writer through an electromagnetic wave; and a reflection member for reflecting an electromagnetic wave reflected from the antenna of the reader/writer toward upper game chips in the stack.

9 Claims, 5 Drawing Sheets

GAME CHIP

The present disclosure relates to subject matters contained in Japanese Patent Application No. 2004-367239 filed on Dec. 20, 2004, which are expressly incorporated herein by reference in its entireties.

BACKGROUND OF THE INVENTION

1. Field of the Invention

The present invention relates to a game chip, and more specifically to a game chip enabling data to be read by a read device such as an IC card reader/writer, etc.

2. Description of the Prior Art

Conventionally, among games familiar to a large number of people, there are games in which a player determines how much he or she bets by placing game chips at an optional position on a game table. A game of this type can be, for example, roulette, card games such as poker, blackjack, etc.

As various amusement facilities have become widespread, equipment that allows a gaming machine arranged in an amusement place such as a game arcade and a casino, etc. to provide a player with more realistic and true-to-life feeling has been introduced, and a number of gaming machines of above-mentioned types have become popular in the market.

Some gaming machines of above-mentioned types request a player to input a target of a bet and the number of chips for the bet by pressing a button through a so-called control panel. These gaming machines are not accompanied by an operation of a player placing game chips, thereby lacking the realistic and real-to-life feeling in playing a game.

Accordingly, there is a proposed technology of embedding an IC chip and an IC tag in a game chip, reading the game chip containing the IC chip, etc. by a gaming machine using a reader/writer, and processing the read data as the input of a player. The technology is disclosed by, for example, Japanese Patent Laid-Open No. 2003-196634 (paragraph [0014]), Japanese Patent Laid-Open No. 2003-085504 (FIG. 1), Japanese Patent Laid-Open No. 2004-021648 (paragraph [0023], FIG. 7), etc.

SUMMARY OF THE INVENTION

Generally, a player at a gaming machine can bet for a target (for example, a specific number, red/black, odd/even, etc.) with any number of game chips. The player makes a bet by laying game chips of the number corresponding to the amount of bet determined by the player in a predetermined area (for example, an area assigned to each of the numbers 1 to 36, an area assigned to each of red/black, odd/even, etc.) on the game table.

In this case, the game chips are to be laid in an area corresponding to the bet target. However, when the number of game chips for a bet is large, the game chips may not be laid within the assigned area. In this case, the game chips are stacked like a tower in the area for the bet target, thereby successfully laying the game chips within the desired area.

However, in a gaming machine operated in the technology of reading game chips using a reader/writer, when game chips are stacked high, the upper game chips are distant from the reader/writer, and an electromagnetic wave as a read signal emitted from the reader/writer is scattered and attenuated in proportion to the height of the stack of the game chips. As a result, it becomes difficult or unstable for the reader/writer to recognize and read the game chips. Especially, when wireless communications are performed using a highly linear high frequency band (for example, a UHF band), not only the game chips vertically above, but also the adjacent chips stacked by the scattered electromagnetic wave can be read.

SUMMARY OF THE INVENTION

The present invention aims at providing a game chip which can be correctly recognized and read without an erroneous read although the game chips are stacked or there are adjacent game chips stacked for a bet in a different position.

As means for solving the above-mentioned problems, the present invention has the following characteristics.

The first aspect of the present invention is proposed as a game chip available as stacked. The game chip stores data readable by a read device (for example, a reader/writer) having an antenna which emits an electromagnetic wave The "game chip" referred to in this specification is a tool for use in indicating a target of a bet and the value of a valuable account (cash, credit, point, etc.) when the player expresses the intention to bet, and the "game chip" in this specification includes coin, medal, etc.

The game chip according to the present aspect has circuit means (for example, a circuit, an IC chip, an IC device, etc.) for communicating data at a request from a read device, antenna means (for example, an antenna (electrode, etc.)) connected to the circuit means and configured such that a resonant state can be entered with an antenna of the read device through a electromagnetic wave, and reflection means (for example, a reflector, a reflection member, etc.) for reflecting the electromagnetic wave emitted by the antenna of the read device toward the upper surface of the stacked game chips.

Since the game chips according to the present invention has reflection means, the electromagnetic wave emitted from the read device is not transmitted or leaked from the inside to the outside of the game chip, but can be transmitted upward within the game chip. As a result, as compared with the case in which an electromagnetic wave is scattered in the air outside a conventional game chip, the game chip according to the present invention can receive an electromagnetic wave from the read device in a strong status.

Using the reflection means, a read signal generated by the read device does not unnecessarily leak to an external space, adjacent chip stacks do not interfere with each other, thereby correctly performing a data read processing by the read device.

With the game chip, the reflection means can be a member arranged at the perimeter of the game chip, and the reflection means of adjacent game chips can touch each other when the game chips are stacked.

With the above-mentioned configuration, since the reflection member is cylindrical and the adjacent cylindrical members touch each other, the electromagnetic wave for a read does not externally leak, but reaches the top game chip without reducing the electric field strength. As a result, although a larger number of game chips are stacked than in the conventional technology, the data of each game chip can be correctly read.

The game chip according to the present invention may have a further feature that the game chip has a body member housing the circuit means and the antenna means, and the reflection means is allocated at a peripheral portion of the body member.

The game chip according to the present invention may have a further feature that the circuit means is cylindrical, the antenna means is a pair of electrodes between which the circuit means is located, and the circuit means and the reflection means are arranged coaxially.

The game chip according to may have a further feature that the reflection means is a metallic foil or a plate made of at least one of iron, aluminum, and steel alloy.

The game chip according to the present invention may have a further feature that the game chip further comprises protection means which surrounds the reflection means.

The game chip according to the present invention may have a further feature that the reflection means and the protection means are substantially the same in thickness.

The accompanying drawings, which are incorporated in and constitute a part of the specification, illustrate embodiments of the invention, and together with the general description given above and the detailed description of the embodiments given below, serve to explain the principles of the invention.

DESCRIPTION OF THE PREFERRED EMBODIMENTS

The embodiments according to the present invention are described below in detail with reference to the drawings.

[1. Gaming Machine Processing Game Chips]

Figure 1:
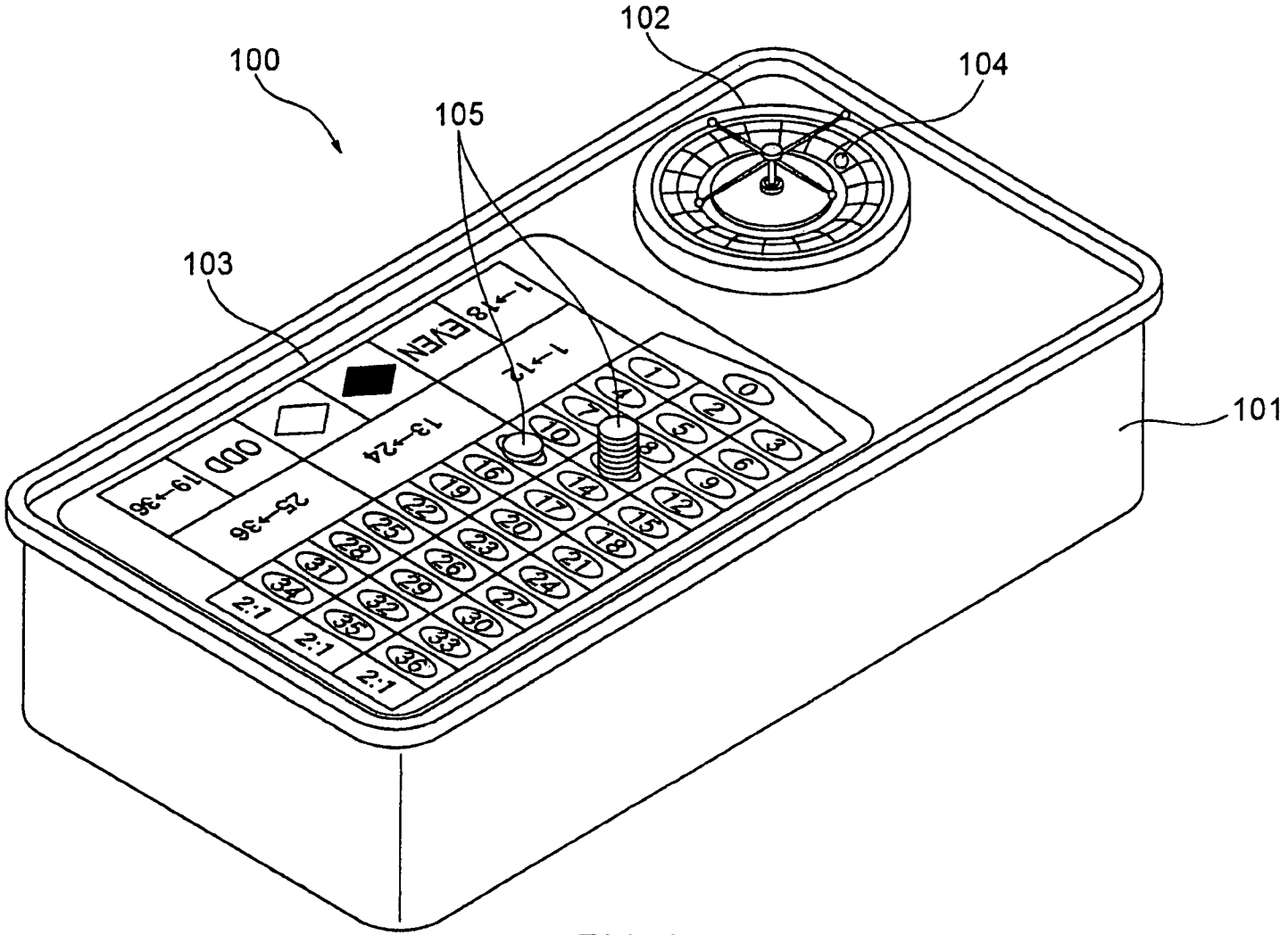
FIG. 1 is a perspective view of a gaming machine.

First, the gaming machine using the game chip according to the present embodiment is explained below. FIG. 1 is a perspective view of the gaming machine using the game chip according to the present embodiment.

A gaming machine 1 according to the present embodiment is a device for allowing a player to play roulette. As shown in FIG. 1, a gaming machine 100 has and a wheel 102 and a layout 103 at an upper surface of table-shaped gaming machine body 101. The wheel 102 has pockets respectively corresponding to the numbers of "0", "00", and "1" to "36". The layout 103 has a plurality of bet areas (area for designation of a target of a bet) corresponding to the numbers of "0", "00", and "1" to "36".

The player predicts which number of pocket a ball 104 thrown into a turning wheel 102 will enter, and lays a game chip 105 in any area in the layout 103 according to the prediction. By the operation of laying the game chip 105, the input of the bet in the gaming machine 100 is performed. If the prediction of the player comes true, the player can receive a dividend depending on the game chips laid for the bet.

Figure 2:
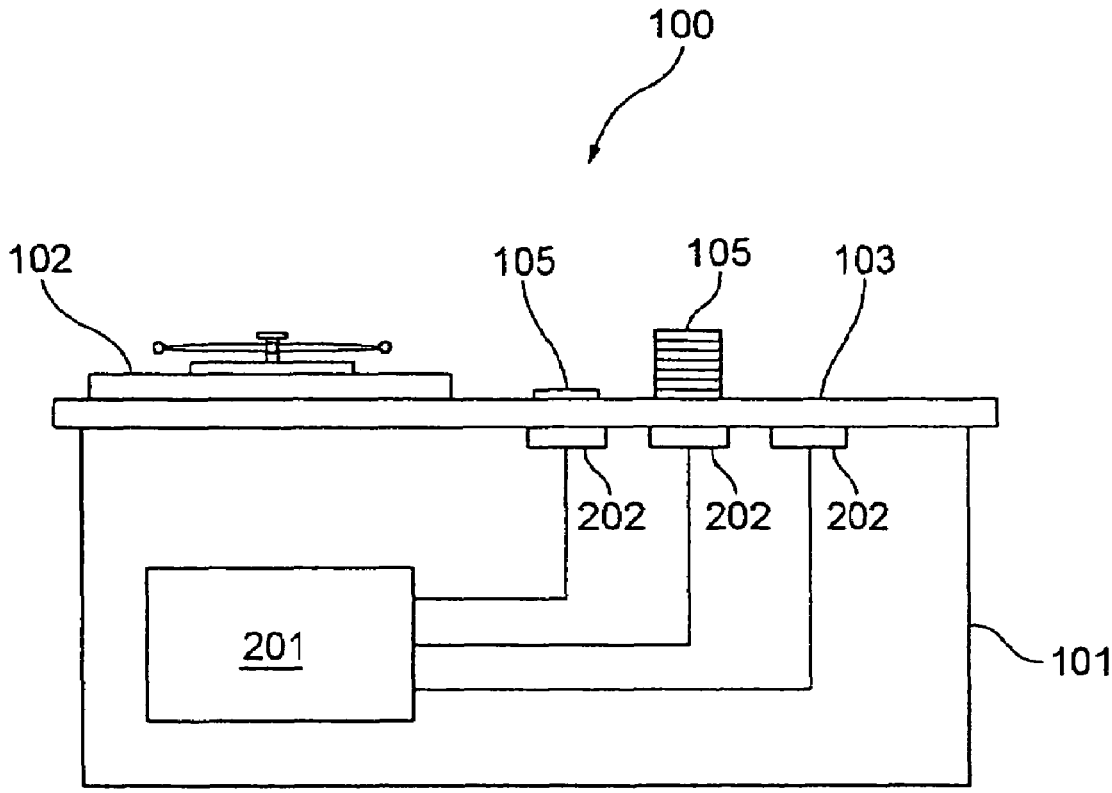
FIG. 2 is a functional block diagram of the gaming machine.

FIG. 2 is a functional block diagram showing the main internal configuration of the gaming machine 100. The gaming machine 100 includes a main control device 201 for control of the main operation of the gaming machine, and a plurality of readers/writers 202 provided under the layout 103 and corresponding to the respective bet areas.

The reader/writer 202 as a read device reads the information (ID information in the present embodiment) stored in the game chip 105 when the game chip 105 is laid in a bet area within its read range, and notifies the main control device 201 of the information. In this specification, it is referred to as a "reader/writer", but it is not always necessary to have a writing function. That is, a device having the function of reading data stored in the game chip 105 can be used as a "reader/writer" in this specification.

The ID information stored in the game chip 105 is the information uniquely designating the game chip 105. According to the ID information, it is discriminated that the game chip 105 relates to what value of which player. The information stored in the game chip 105 is not always ID information designating the game chip 105, but can be any information discriminating that the game chip 105 indicates what value of which player. For example, player ID information and chip value information (for example, the information indicating the value of one coin, the value of ten coins, the value of 100 coins, etc.) can be stored together in the game chip 105.

The main control device 201 recognizes which player makes a bet in which bet area by receiving read information from each reader/writer 202. The main control device 201 detects using a sensor (not shown in the attached drawings) provided in the wheel 102 about in which pocket the ball stops, determines the winning/losing status of each player and the dividend according to the information transmitted from the reader/writer 202 about which player makes a bet with how many chips laid in which bet area, and performs a game process such as adding a dividend to the credit of the player on the separately provided display device (not shown in the attached drawings) showing the payout.

[2. Example of Configuration of Game Chip]

Figure 3:
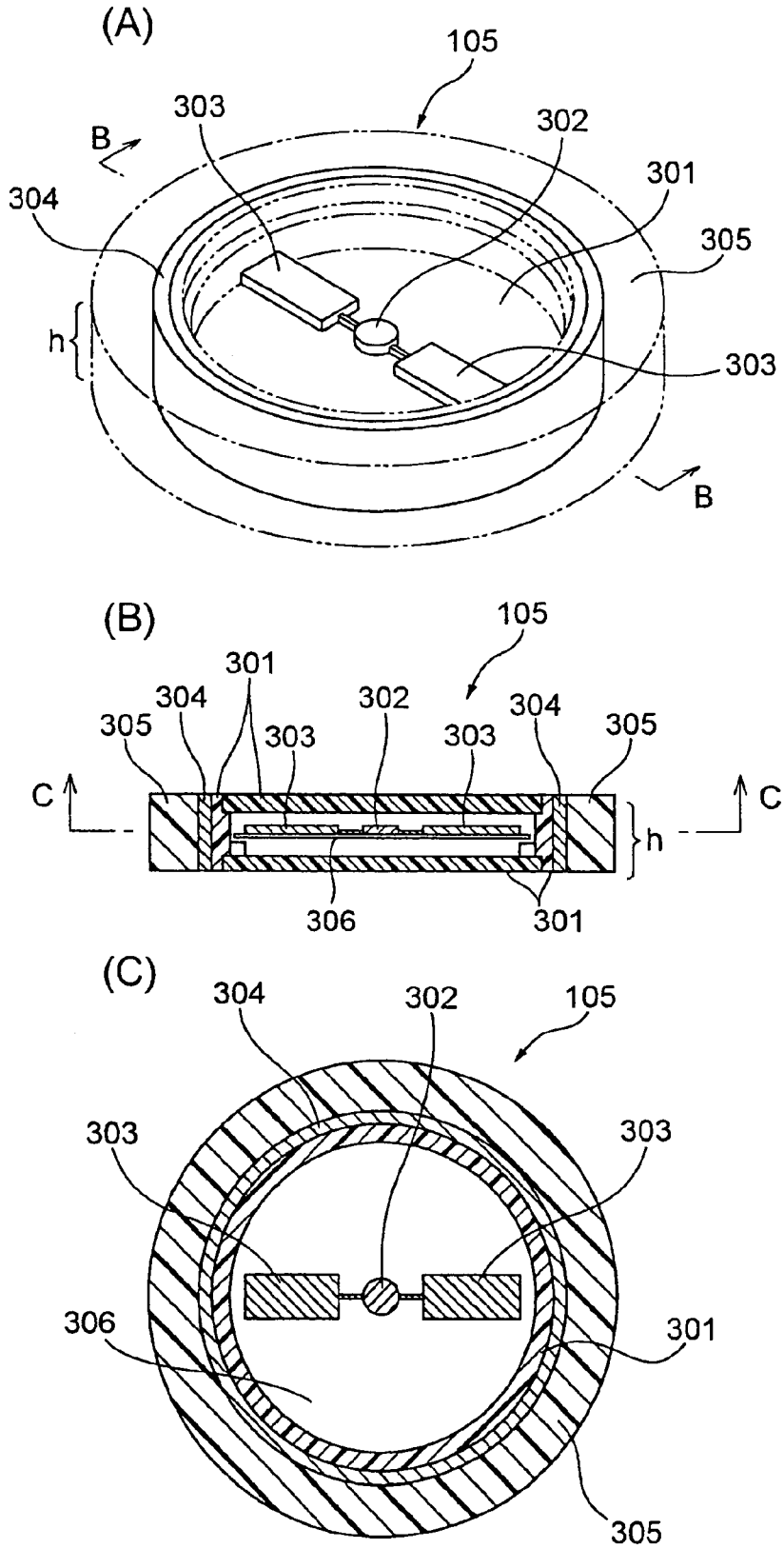
FIG. 3(A) is a perspective view of a game chip.
FIG. 3(B) is a sectional view along the line B-B in FIG. (3A)
FIG. 3(C) is a sectional view along the line C-C in FIG. (3B)

The example of the configuration of the game chip 105 according to the present embodiment is explained below by referring to FIGS. 3(A) to 3(C). FIG. 3(A) is a perspective view of the game chip 105. FIG. 3(B) is a sectional view along the sectional line B-B shown in FIG. 3(A). FIG. 3(C) is a sectional view along the sectional line C-C shown in FIG. 3(B).

As shown in FIGS. 3(A) to 3(C), the game chip 105 houses a substrate 306 in a body 301 formed of a resin, etc. The substrate 306 has an IC device 302 mounted on it as circuit means, and an antenna electrode 303 as antenna means connected to the IC device 302. A reflection member 304 is an annular member, and fitted to the body 301 so as to surround an outer peripheral surface of the body 301. The reflection member 304 is formed of a material having a characteristic of reflecting electromagnetic waves emitted by the reader/writer. A protection ring 305 is a cylindrical member for protecting the body 301 and the reflection member 304, outside the reflection member 304.

The reflection member 304 is provided outside the antenna electrode 303, but it is not limited to the outside of the body 301.

The IC device 302 is an electronic part designed to perform a processing function, a storage function, and an input/output control function, and has the function of passing stored information to the reader/writer 202 at a request from the reader/writer 202.

The antenna electrode 303 performs communication of a signal between the reader/writer 202 and the game chip 105, converts a carrier wave from the reader/writer 202 to electric power, and provides the power for the IC device 302.

The reflection member 304 is an annular member arranged around the peripheral surface of the body 301, and it is preferable that the height h of the reflection member 304 is substantially equal to the thickness of the game chip 105. When a plurality of game chips 105 are stacked, reflection members 304 of the adjacent game chips 105 can contact each other.

The reflection member 304 can be formed any material having the characteristic of reflecting an electromagnetic wave emitted by the reader/writer 202. For example, it can be a film or a plate of metal such as copper, aluminum, steel, etc.

The form and the arrangement position of the reflection member 304 are not limited to the applications shown in FIGS. 3(A) to 3(C). It can be of any shape other than an annular shape so long as the game chips 105 can contact the reflection member 304 of the adjacent game chips 105 when the chips are stacked. The reflection member 304 is not always solid, but can be a mesh- or grating member wound around the perimeter of the body 301.

[3. Example of Operation of Game Chip]

Explained below is an example of the operation of the game chip 105.

Figure 4:
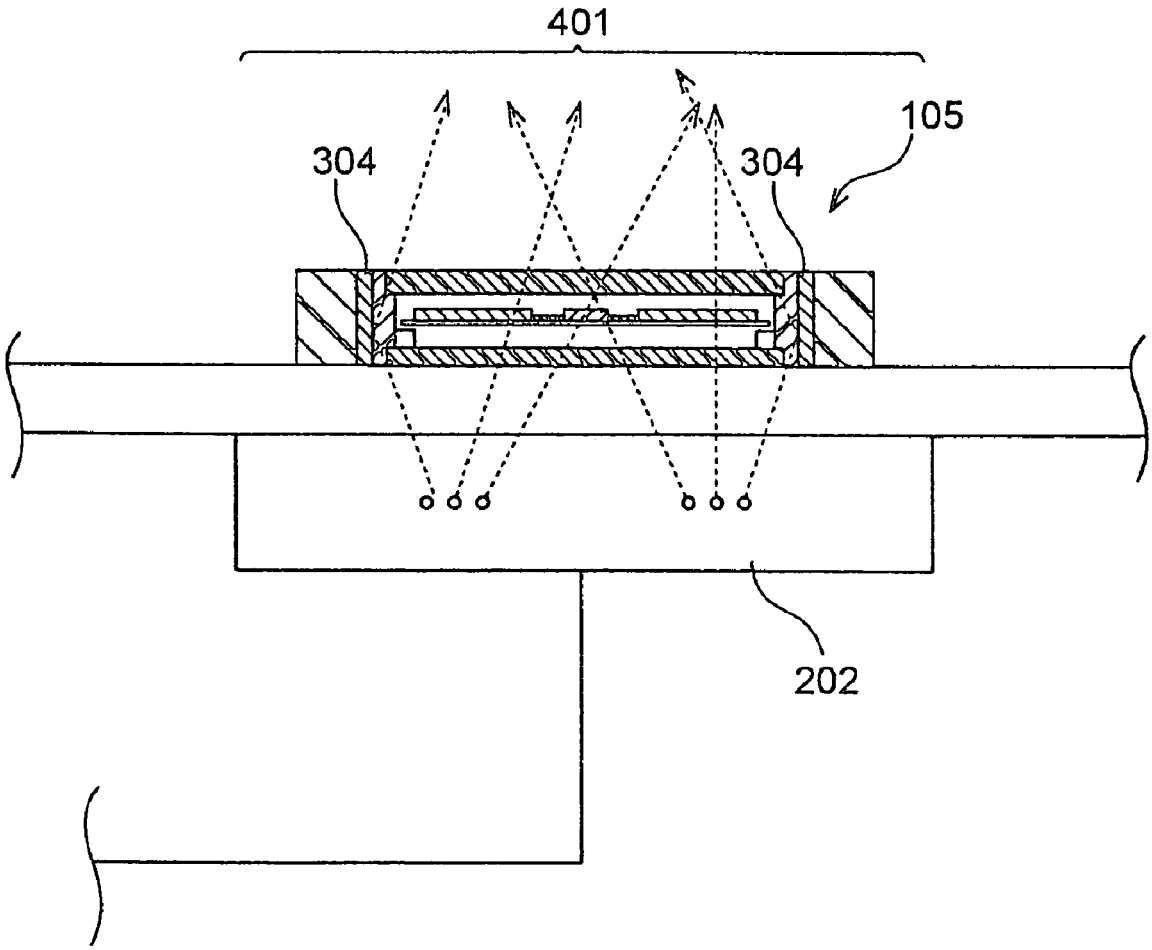
FIG. 4 shows an electromagnetic wave generated when a reader/writer reads a game chip.

FIG. 4 shows the state of the electromagnetic wave generated when the reader/writer 202 reads the game chip 105 placed on the layout 103.

The reader/writer 202 generates a high frequency (for example, 880 MHz to 2.45 GHz) for a read, and emits it as an electromagnetic wave from an antenna (electrode). The transmitted electric wave is received by the antenna electrode 303 of the game chip 105, and provides power for an IC chip for a game.

The game chip 105 receives the transmitted electric wave, the antenna electrode 303 of the game chip 105 enters the resonant state with the reader/writer 202, and means for switching the load resistance in the game chip 105 can detect data transmitted from the game chip 105 on the reader/writer 202 side.

Figure 5:
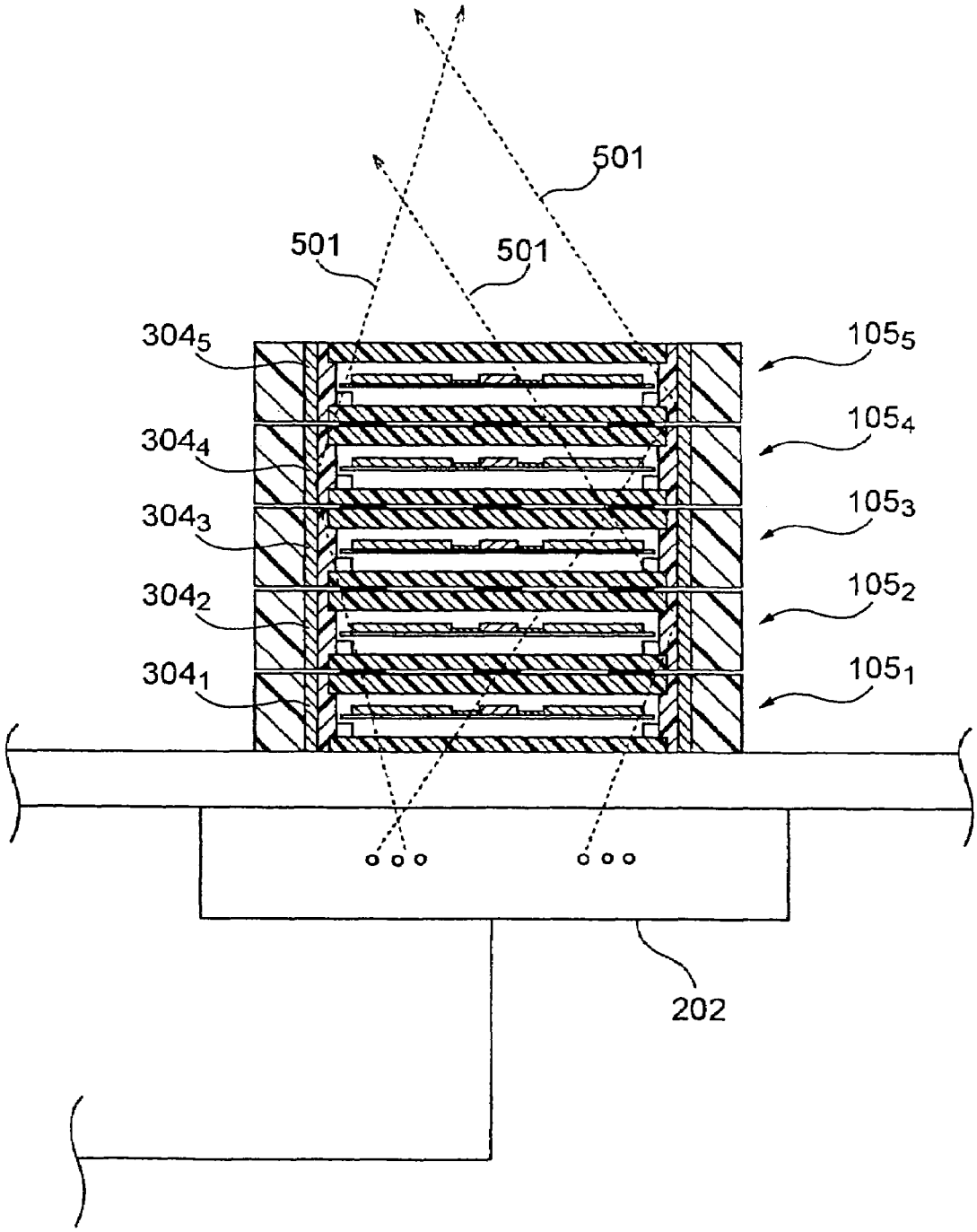
FIG. 5 shows an electromagnetic wave generated when a reader/writer reads a game chip.

The status of the electromagnetic wave when the reader/writer 202 reads the game chip 105 placed on the layout 103 with a plurality of game chips 105 stacked is explained by referring to FIG. 5. FIG. 5 shows an example of the status of the electromagnetic wave when the game chip 105 is read with the chips stacked.

In the example shown in FIG. 5, the stack of five game chips $\mathbf{105}_1$ to $\mathbf{105}_5$ is read by the reader/writer 202.

An electromagnetic wave 501 is emitted from the reader/writer 202 into the game chips $\mathbf{105}_1$ to $\mathbf{105}_5$, reflected by a cylindrical inner wall configured by the reflection members $\mathbf{304}_1$ to $\mathbf{304}_5$ of each of the game chips $\mathbf{105}_1$ to $\mathbf{105}_5$, and can reach the game chip $\mathbf{105}_5$ positioned at the top without leaking outside the game chips $\mathbf{105}_1$ to $\mathbf{105}_5$.

With the conventional game chip, the electromagnetic wave reflected by the cylindrical inner wall configured by reflection members $\mathbf{304}_1$ to $\mathbf{304}_5$ is lost without reaching the upper game chips. However, with the game chip 105 according to the present embodiment, upper game chip 105 in a stack can be effectively read using the electromagnetic wave which has been lost in the conventional technology. Thus, a higher stack of game chips can be read.

The present invention has been explained as a game chip applied to a gaming machine, but the present invention is not limited to a game chip, and can be applied to all devices in a noncontact communication system using electromagnetic coupling such as an IC card, an IC tag, etc.

ADVANTAGES OF THE INVENTION

According to the present invention, although game chips are stacked, the game chips can be correctly recognized, and the data or information stored in the game chips can be successfully read.

Additional advantages and modifications will readily occur to those skilled in the art. Therefore, the invention in its broader aspects is not limited to the specific details or representative embodiments shown and described herein. Accordingly, various modification may be made without departing from the spirit or scope of the general inventive concept as defined by the appended claims and their equivalents.

What is claimed is:

1. A game chip comprising:

a circuit for receiving a data request from a read device and transmitting data in response to receiving a data request from the read device;

an electromagnetic antenna connected to the circuit for receiving the request for data from the read device as an electromagnetic signal and for transmitting data;

a body housing the circuit and the antenna;

an annular protector located at and defining an outer periphery of the game chip and protecting the body; and an annular electromagnetic wave reflector located between the body and the protector, wherein, when a plurality of the game chips are arranged in a stack, each annular electromagnetic reflector of each game chip in the stack forms a part of a stack electromagnetic wave reflector of the stack, reflecting electromagnetic waves radiated by the read device at a first end of the stack, so the electromagnetic waves reach the game chip at a second end of the stack, opposite the first end of the stack, by reflection of the electromagnetic waves from the stack electromagnetic wave reflector of the stack, and each chip has a height along an axial direction of the stack of game chips.

2. The game chip according to claim 1, wherein the circuit is cylindrical, the antenna includes a pair of electrodes between which the circuit is located, and the circuit and the annular electromagnetic wave reflector are coaxial.

3. The game chip according to claim 1, wherein the annular electromagnetic wave reflector is a metallic foil or sheath selected from the group consisting of copper, aluminum, and steel.

4. The game chip according to claim 1, wherein the annular electromagnetic wave reflector and the annular protector have substantially the same height.

5. The game chip according to claim 1, wherein, in the stack of the game chips, each annular electromagnetic wave reflector of a game chip in the stack is in contact with the annular electromagnetic wave reflector of an adjacent game chip in the stack.

6. The game chip according to claim 1, wherein, in the stack of the game chips, the annular electromagnetic wave reflector of each game chip has a height substantially equal to the height of the each of the game chips, so that each annular electromagnetic wave reflector of a game chip in the stack is in contact with the annular electromagnetic wave reflector of an adjacent game chip in the stack.

7. The game chip according to claim 1, wherein the annular protector is a resin.

8. The game chip according to claim 1, where the annular electromagnetic wave reflector is thinner than the annular protector.

9. A stackable game chip stacked by a game player, with other stackable game chips, in placing a bet in an area of a game table that includes one of a plurality of read devices for reading data stored in game chips and placed on respective areas of the game table including respective read devices , via electromagnetic waves radiated by the read devices, the game chip comprising:

a circuit receiving data from and transmitting data to a read device in response to a request from the read device;

a game chip antenna connected to the circuit for communication with the read device, through an antenna of the read device, via electromagnetic waves;

a body member housing the circuit and the antenna of the game chip;

an annular protector located at an outer periphery of the body member; protecting the body member; and an annular reflector located between the body member and the annular protector and reflecting electromagnetic waves, wherein, in a stack of a plurality of the game chips placed on the area of the game table having the read device, the annular reflectors of the game chips form an interior wall reflecting the electromagnetic waves radiated from the antenna of the read device so the electromagnetic waves reach the game chip of the stack that is most remote from the game table via reflection from the annular reflectors of the game chips in the stack.

* * * * *